United States Patent [19]

de Smet

[11] Patent Number: 4,833,903

[45] Date of Patent: May 30, 1989

[54] METHOD AND DEVICE FOR PRESS-FORMING SHEET METAL

[75] Inventor: Gabriel de Smet, Courbevoie, France

[73] Assignee: Union Siderurgique du Nord et de l'est de la France (USINOR), Puteaux, France

[21] Appl. No.: 113,470

[22] Filed: Oct. 28, 1987

Related U.S. Application Data

[62] Division of Ser. No. 735,237, May 17, 1985, abandoned.

[30] Foreign Application Priority Data

May 17, 1984 [FR] France ..... 84 07678

[51] Int. Cl.[4] ..... B21D 22/10

[52] U.S. Cl. ..... 72/57; 72/350

[58] Field of Search ..... 72/350, 351, 349, 56, 72/57, 60, 63

[56] References Cited

U.S. PATENT DOCUMENTS

| | | | |
|---|---|---|---|
| 2,344,743 | 3/1944 | Smith, Jr. | 72/63 |
| 2,783,728 | 1/1957 | Hoffmann | 72/57 |
| 3,075,485 | 1/1963 | Mitchell | 72/63 |
| 3,769,824 | 10/1973 | Granzon | 72/57 |
| 3,914,969 | 10/1975 | Banks | 72/63 |
| 4,689,979 | 9/1987 | Otsuka et al. | 72/57 |

FOREIGN PATENT DOCUMENTS

| | | | |
|---|---|---|---|
| 710730 | 1/1980 | U.S.S.R. | 72/57 |
| 912341 | 3/1982 | U.S.S.R. | 72/57 |

*Primary Examiner*—David Jones

*Attorney, Agent, or Firm*—Cushman, Darby & Cushman

[57] ABSTRACT

A sheet of metal of given thickness is press-formed to provide a part having a substantially constant thickness on a double action press. The sheet to be formed is disposed on a support. A first outer slide, or blank holder is applied on the peripheral portion of the sheet. A second central slide is applied on the central portion of the sheet. The peripheral portion of the sheet is formed while allowing it to slide under the blank holder, by displacing relative to said support at least one active part of the outer slide so as to compensate, in certain regions of the finished part, for excess areas of the sheet, for the given thickness of said sheet, relative to the volume of metal to be formed, and displacing simultaneously with the displacement of the part the central slide so as to shape angular volumes of the central portion of the sheet by application of the sheet against the surfaces of the central part of the support.

20 Claims, 6 Drawing Sheets

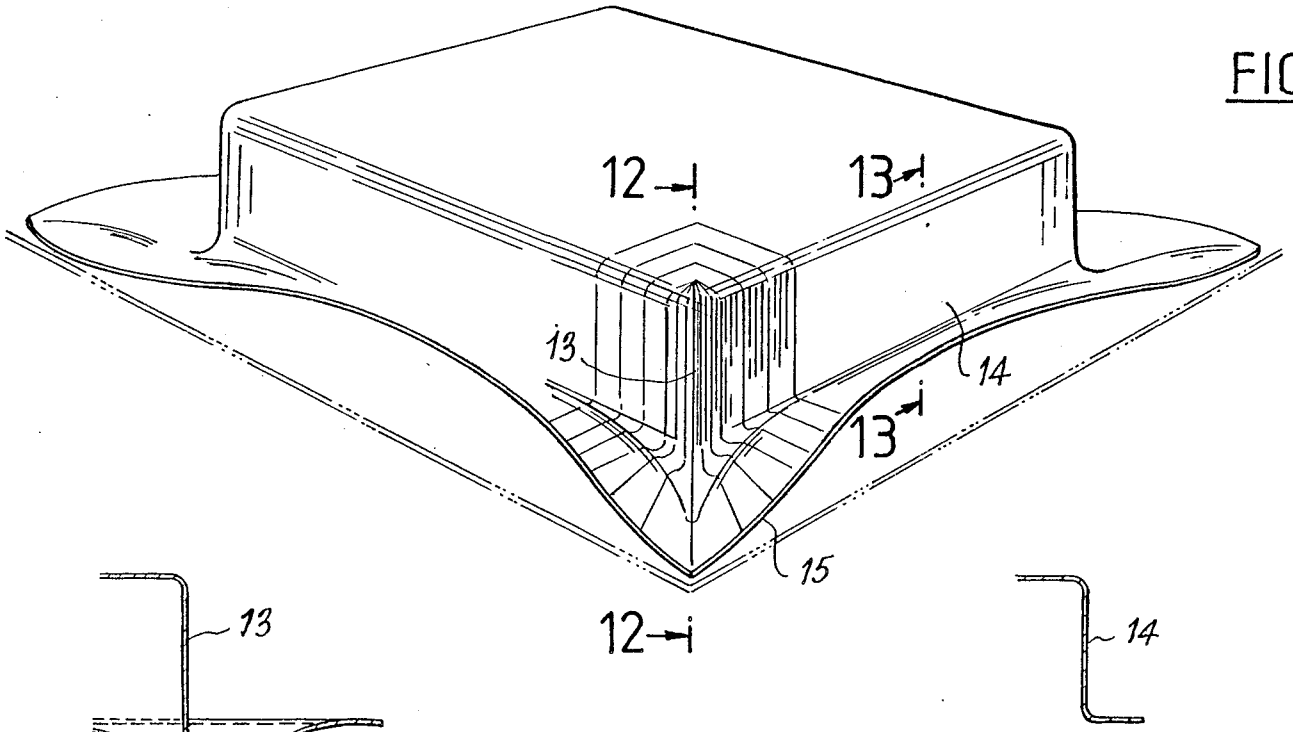
FIG.11
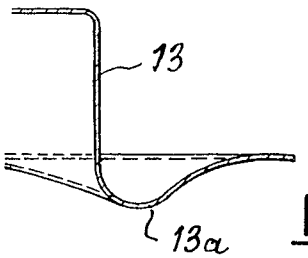
FIG.12
FIG.13

METHOD AND DEVICE FOR PRESS-FORMING SHEET METAL

This is a division of application Serial No. 735,237 filed May 17, 1985, now abandoned.

The present invention relates to a method and device for press-forming sheet metal, in particular sheets of extra thin steel of large dimensions used for example in the automobile industry or having shapes including relatively closed dihedral angles.

The development of computerized calculations in particular employed by automobile constructors in the field of the design of vehicle body structures, especially by analytic methods such as that termed "finished elements", has permitted a considerable reduction in the time spent in the design of the parts while the behaviour of the latter under stress has been more closely approached. It is therefore theoretically possible to optimize the shapes and the thicknesses of the sheets in accordance with the degree of stress.

The lower limit of the thicknesses is however limited by the present press-forming techniques which do not permit the use, in the dimension of body parts, of steel sheets whose thickness is less than about 55/100 mm owing to the tearing which occurs in the regions subjected to a drawing operation or the pleating in the regions subjected to a shrinking of the press-formed sheet.

The press-forming of parts of large dimensions is usually carried out by a drawing operation with mechanical or hydraulic double action presses. These machines mainly comprise a fixed die and two independent slides, namely a central slide, termed a ram or piston plunger carrying a punch, and an outer slide used for operations for holding the blank, i.e. for providing a sufficient maintenance to permit the drawing under the punch by reaction. The movements are usually the following: (1) a rapid descent of the blank holder which maintains a constant pressure on the sheet and thus prevents it from moving; (2) a rapid descent of the punch until it comes into contact with the sheet, then (3) a slow descent of the punch during the press-forming stage, namely the drawing proper; and (4) a rapid rising of the central slide which raises the blank holder therewith.

This conventional method is illustrated in the French Pat. No. 756 767 in which the whole of the press-forming operation is effected by a drawing and therefore a decrease in the thickness of the sheet. It appears that this conventional method does not permit the press-forming of extra thin sheets (having a thickness $<$50/100 mm) since the rigidity of the die and of the punch and the clamping of the sheet by the blank holder would produce non-homogeneous deformations resulting, in certain regions, in elongations liable to produce an excessive reduction in the thickness bearing in mind the small initial thickness of the sheet, and, in other regions, in shrinkages tending to produce a thickening of the sheet which, in practice, result in the formation of pleats owing to its low resistance to buckling (which resistance varies as a function of the square of the thicknesses). Further, the variations in localized stresses due to the shape of the part and to the tolerances in the realization of the tools result in tears. In order to overcome the problem of the formation of pleats, the aforementioned French patent proposes means disposed in the blank holder which effect in themselves an additional drawing of the sheet in regions where its drawing is insufficient relative to that exerted by the punch in the other regions.

These difficulties are also encountered when producing angular volumes for relatively thicker sheets, these difficulties being of course increased in respect of extra thin sheets.

A method, termed the "Guerrin method" is also known which comprises forming by means of a punch a sheet of metal which rests on a mass of elastomer having a high Shore hardness of about 90, bearing in mind that it must ensure the close application of the blank of sheet metal against the punch so as to achieve precision in the production of the part. However, the main drawback of this method is to consume a great amount of energy. Indeed, there is added to the energy required for forming the sheet metal blank that required for forming the impression, corresponding to the shape of the part, in the mass of elastomer, plus the frictions produced by the latter on the entire surface of the part during the forming operation.

This excludes the possibility of the production of parts of large dimensions obtained by this method on existing presses.

Further, this method does not avoid the formation of pleats, the pressure gradients generated by the deformation of the elastomer decreasing as one approaches the upper area of the mass of elastomer, above all in the production of angular shapes, the sheet being insufficiently held in position on its periphery owing to the fact that the work is carried out on a single action press.

Lastly, a forming method is known which employs a fluid under pressure to produce simple shapes of the hemispherical type. However, this technique cannot be used for complicated shapes since it is then necessary to apply the sheet against the die, which cannot be achieved in this technique.

This is why, notwithstanding recent considerable progress in the mechanical characteristics of steel sheets having a high elastic limit, it has not been possible to manufacture body parts or other parts from extra thin sheet.

An object of the invention is therefore to provide technology whereby it is possible to press-form metal sheets having angular volumes and in particular sheets of extra thin steel ($<$50/100 mm) in mass production under competitive, economical conditions. By steel sheets having a high elastic limit (HEL) is meant steels in respect of which $E<350$ MPa.

The invention therefore provides a method for press-forming sheets having a substantially constant thickness on a double action press, comprising disposing the sheet to be formed on a support, applying a first slide outside the blank holder on the peripheral portion of the sheet, then applying a second central slide on the central portion of the sheet, wherein the peripheral portion of the sheet is formed by allowing it to slide under the blank holder by means of at least one active part of the outer slide so as to compensate in certain regions of the finished part for the excess areas having an unchanged thickness of the initial sheet, relative to the volume to be formed and, simultaneously, and in coincidence, the central slide is displaced so as to shape the angular volumes of the central portion of the sheet by application of the sheet against the areas of the central portion of the support constituting a die.

According to a modification, an elastically yieldable material is chosen as the support material and, upon the action of the outer slide on the sheet for the purpose of compensating, for a substantially constant thickness, in certain regions of the finished part, for the excess areas relative to the volume to be formed, the mass of the support is made to flow so as to deform the central portion of the sheet in such manner as to impart thereto an area substantially equal to the area of the finished part to be obtained, and then the central slide is displaced so as to shape the angular volumes and the central portion of the sheet by a final flow of the support.

This modification, which concerns more particularly ultra-thin sheets, permits the obtainment of the simultaneity and the coincidence of the forming action of the peripheral portion of the sheet in certain regions and the shaping of the central portion of the sheet which has been described in the preceding embodiment. It should be noted that, in this modification, the part of the central slide performs the function of the bottom of a die and the support of flowable material performs the function of a punch applying the sheet against the bottom of the die for forming the angular volumes.

Thus the invention is based on the principle of the equality between the areas of the initial planar sheet metal blank and the shaped blank which corresponds strictly to the shape of the desired press-formed part plus the extra peripheral areas shaped under the blank holder, thereby conditioning the maintenance, with a substantially constant thickness of the part, of the equality of the stresses which will be explained hereinafter.

According to other important features of the invention:

- in a first stage, the central slide is brought into a position in which it limits the deformation of the central portion of the sheet under the effect of the flow of the support material;
- anti-friction means are provided on the active part of the outer slide and on the support;
- the material of the support is an elastomer having a low Shore hardness, for example lower than 30 and preferably higher than 10;
- the material of the support is decompressed after the forming operation proper;
- the mass of the support material is cooled.

According to a mixed variant, the elastic material is located in at least a peripheral region of the support corresponding to at least the active part of the outer slide and extending in at least a region immediately adjacent to the central slide.

In this mixed variant which concerns the forming of relatively thicker sheets for very angular volumes, the support material has a Shore hardness preferably between 70 and 100.

This relatively harder elastic material has the drawbacks mentioned before concerning the energy consumed. However, as its area is limited, the energy required for forming the impression in the elastomer mass is also limited in a corresponding proportion, thereby rendering the method technically acceptable.

The invention also provides a press-forming device of the type comprising a support on which the sheet to be formed is placed, a first outer slide or blank holder, and a second central slide, wherein the first outer slide comprises an active part in relief whose shape corresponds to the excess area of the sheet for a substantially constant thickness, relative to the volume to be formed, this active part acting on the peripheral portion of the sheet simultaneously and in a relation with the action of the central slide.

The active part in relief of the outer slide is carried by an element which is movable in translation independently of the outer slide which cooperates with a complementary shape provided in the support.

According to a first variant, the support comprises a mass of an elastic material occupying the entire area corresponding to the outer slide and to the central slide.

The elastic support material is preferably easily flowable, for example an elastomer having a Shore A hardness lower than 30 and preferably higher than 10, but which may be lower than 10 in order to minimize the energy required for its deformation, which is dissipated in the form of heat.

According to other features of the invention:

- the support and the active part of the slide have anti-friction properties;
- means are provided which, in a first stage, project into the mass of the support material and which, in a second stage, may be retracted, after the forming operation, so as to produce a decompression of said material;
- means are provided for cooling within the mass of the material of the support;
- means are provided for stripping the finished part from the support material.

According to a mixed variant, the elastic support material is located in a peripheral region corresponding to the active part of the outer slide and extending in a region immediately adjacent to the part of the central slide.

In this embodiment, the support material has a Shore hardness preferably between 70 and 100.

The invention will be described hereinafter in more detail with reference to the accompanying drawings which show one embodiment of the invention. In the drawings:

FIG. 11 is a perspective view of a parallel-sided part formed in accordance with the invention, and FIGS. 12 and 13 are two partial sectional views of the part shown in FIG. 11;

Figure 1:
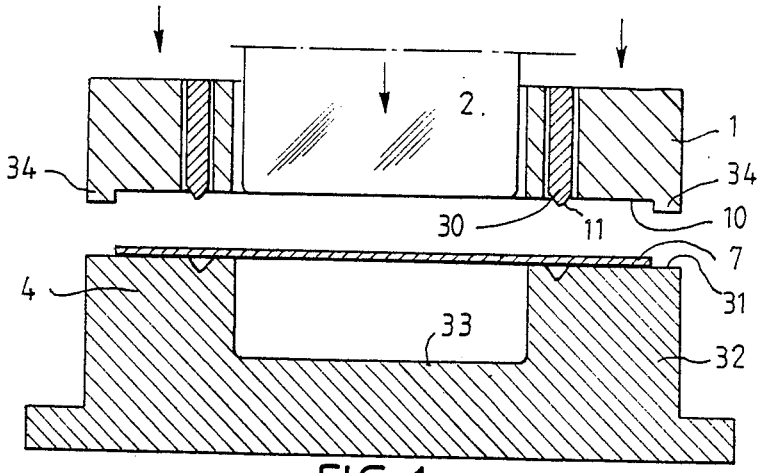
FIGS. 1 to 10 are diagrammatic sectional views of three embodiments of the press-forming device according to the invention in the course of successive stages for forming a part.

In the first embodiment shown in FIGS. 1 to 4, the device of FIG. 1, in its position before the forming operation, comprises the conventional component elements of a double action press and consequently only the part relating to the invention has been shown.

An outer slide, or blank holder, 1 carrying a peripheral portion 10 and a central slide 2 forming a punch, are in the upper position, while the sheet metal blank 7 to be formed is placed on a support 4 forming a die. The peripheral portion 10 includes in its corners active portions 11 in relief carried by elements or pillars 30 which are movable in translation in corresponding cavities formed in the blank holder 1. The active portions 11 in relief have a suitable shape which corresponds to the excess area relative to the volume to be formed of the part it is desired to produce, for example such as that illustrated in FIG. 11.

The support 4 of a hard material, for example of metal, forms the die and includes a peripheral portion 31 in which are formed hollow or recessed portions 32 corresponding to the complementary shape of the active portions 11 in relief of the pillars 30. The central portion 33 of the support 4 constitutes a die bottom and has the shape of the finished part in its central region.

The peripheral portion 10 of the outer slide 1 includes on its outer edges shims or packing elements 34 which bear against the peripheral portion 31 of the support 4 so as to permit, notwithstanding the fact that the sheet metal blank 7 is held, the displacement by sliding of the excess material in the cooperating portions 11, 32.

The stage shown in FIG. 1 constitutes the stage for placing the sheet metal blank 7 in position, the outer slide of the blank holder 1 being raised, as are the movable elements 30 and the central slide 2.

Figure 2:
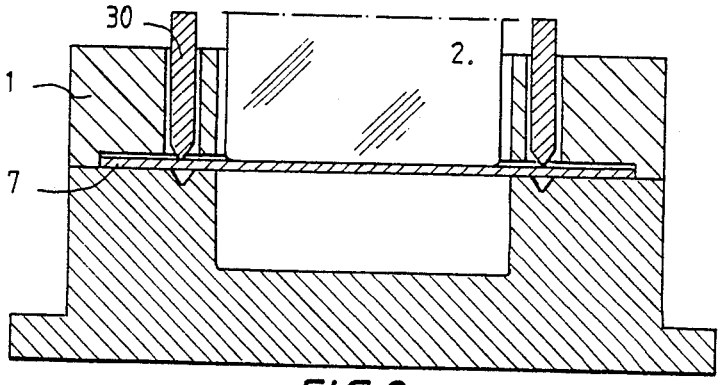

FIG. 2 represents the stage in which the blank holder is put into contact with the sheet 7 by the descent of the outer slide 1 and the punch 2. In the course of this stage, the movable elements 30 do not move and are withdrawn within the blank holder relative to their initial projecting position, so that the sheet is not stressed by any deformation and is only subjected to the controlled clamping operation effected by the blank holder on its peripheral portion.

Figure 3:
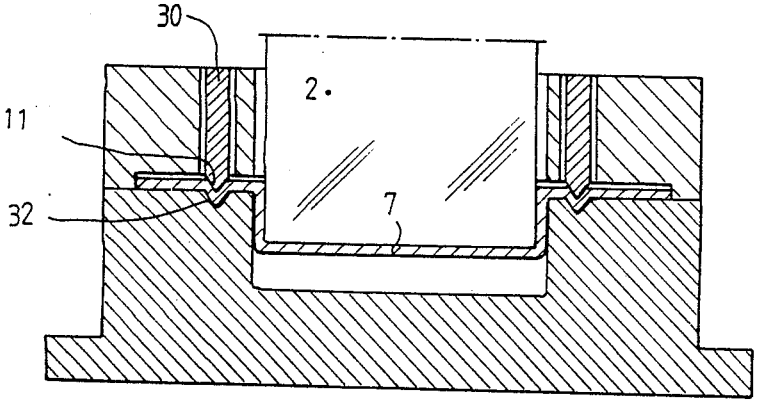

FIG. 3 illustrates a stage in which the part is actively shaped and there is shown a simultaneous descent in relation with each other of the movable elements 30 and the punch 2 so as to progressively absorb the excess area in certain regions of the part to be formed, owing to the active part 11 and its complementary part 32 while maintaining the sheet in a taut condition against the punch by a controlled sliding thereof under the blank holder.

Figure 4:
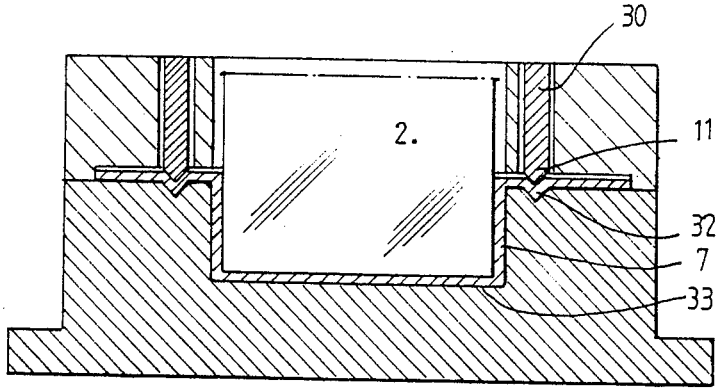

In the stage shown in FIG. 4, the active part of the punch has reached the bottom of the die 33 and the movable elements 30 also have their active pats 11 cooperating with the complementary parts 32 thereby clamping the sheet 7 and thus absorbing the excess areas of the sheet relative to the volume of the finished part to be formed, thereby avoiding the formation of pleats, due to the shrinkage, or reduction in the thickness anywhere in the sheet.

The device shown in FIGS. 5 to 9 illustrates a second embodiment of the device and method according to the invention in which the simultaneous and coordinate relative movement of the projecting active parts 11 of the peripheral slide 1 and the central slide 2 is obtained.

Figure 5:
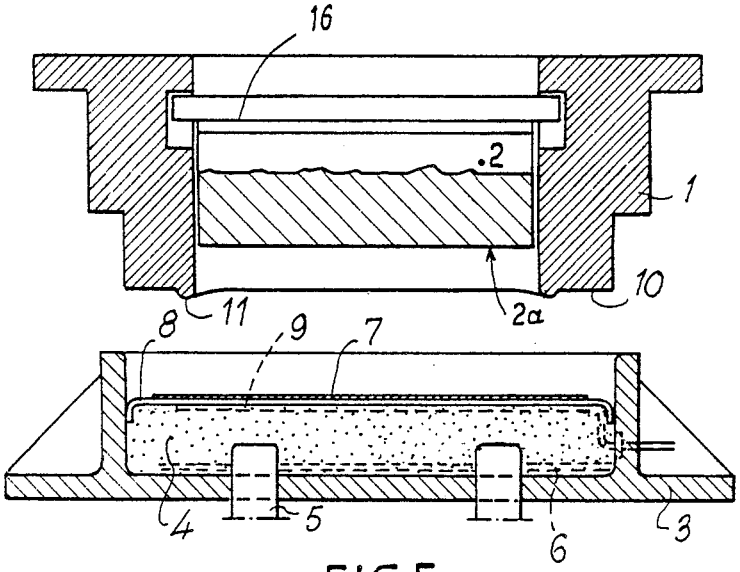

The device, shown in FIG. 5 in its position before the forming operation, comprises the conventional component elements of a double acting press which have already been described and carry the same reference numerals as before. The outer slide or blank holder 1 carries a peripheral part 10 constituting a die which has, in its corners, a suitable part in relief 11 which is in one piece with the peripheral die 10 (this part in relief 11 is adapted to press-form a portion of the sheet whose area corresponds to an excess area of the initial blank of sheet relative to the volume of metal to be formed of the part it is desired to produce, for example such as that illustrated in FIG. 11) and its active surface is carefully polished so as to, permit the displacement of the excess material during the forming operation. This active surface may also be treated so as to facilitate the sliding of the material.

The central slide 2 carries a die bottom 2*a* and is in its raised position, while the sheet metal blank 7 to be formed is placed in the centre of a support 4 disposed in a container 3 (bolster). In this case, it should be noted that there is an inversion of the die-punch functions which will be clear in the following description of this embodiment. Indeed, the support of the easily flowable elastic material performs the function of a punch by a deformation of this material.

The support 4 is formed by an elastomer having a Shore hardness lower than 30 and preferably higher than 10, and a very important characteristic resides in the time the material takes to return rapidly to its initial shape (preferably less than 1 second). For example, there may be employed a natural rubber foam having a Shore hardness of about 15 and a very short deformation time, of the order of 1 sec. There may also be used other conventional gels or foams having preferably high plasticity, for example silicone elastomers or foams having cavities which may be filled with a liquid.

A composite support may also be used which comprises a substantially parallel-sided mass based on a silicone elastomer having a Shore hardness of 10 to 20, and covered on its upper side and on the whole or a part of its lateral sides with a relatively thin skin (for example having a thickness of 10 to 15 mm) made of a stronger and harder material such as a silicone having a Shore hardness of 50 or Teflon having advantageous anti-friction properties.

Retractable elements 5 (inflatable bags or pillars) project into the elastomer acting as the support 4 and their inserted volume represents approximately the volume of the recovery of the elastomer after the forming operation.

The support 4 is covered with a sheet of plastics material 8, for example Teflon, interposed between the sheet 7 and the elastomer which may be, as the case may be, adhered or welded to the elastomer and which has for principal function to facilitate the sliding of the sheet metal during the forming operation, but it may further serve to protect the elastomer as indicated in the preceding composite structure.

The support 4 comprises conduits 6 permitting the circulation of a cooling fluid, such as compressed air. Other conduits 9 may, in particular when compressed air is used, serve to strip the finished part. For the cooling of the support mass 4, embedded metal wires or a metal powder filler may also be provided for improving the thermal conductivity.

Figure 6:
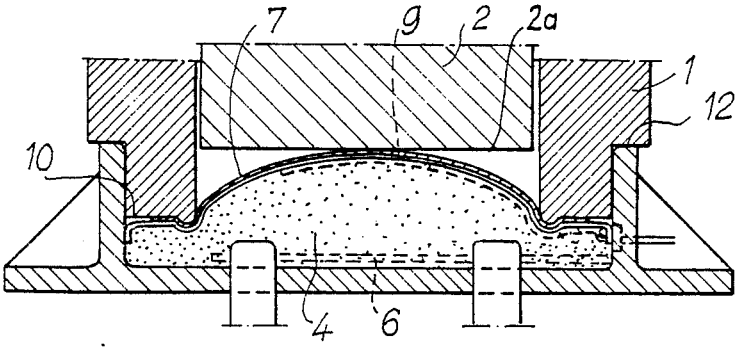

FIG. 6 shows the stage of the pre-forming of the part. The blank holder slide 1 carrying the peripheral die 10 is lowered. This die comes into contact with the sheet metal blank 7 which compresses by reaction the elastomer support 4. The elastomer, under the effect of this peripheral compressive action, acts by a flowing thereof on the central region of the sheet metal blank and deforms the latter.

The swelling of the central portion of the sheet metal blank is limited by the die bottom 2*a* fixed to the central slide 2 so as to avoid uncontrolled erratic deformations due to the anisotropy of the metal or to dissymetrical part shapes. According to one of the features of the invention, the lowering of the blank holder 1 carrying the peripheral die 10 is limited by adjustable mechanical stops 12, 16, so that the deformation of the sheet metal blank in its central portion results in a surface substantially equal to that of the finished part to be obtained.

Figure 7:
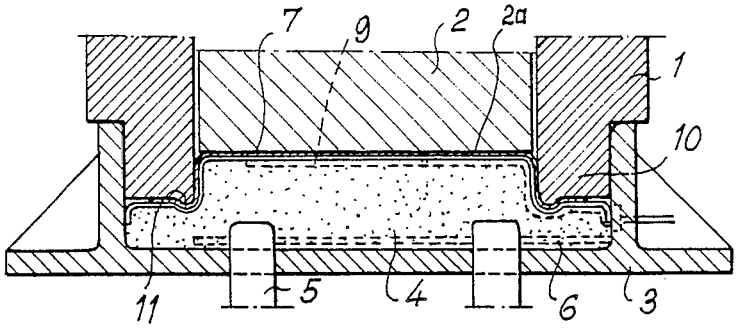

FIG. 7 represents the stage in which the part is finally shaped. The central slide 2 carrying the die bottom 2*a* descends to its lower position and produces the final forming of the central portion of the sheet 7 which had been pre-formed in the preceding operation.

The compressive stresses due to the bearing of the die bottom 2a against the top of the sheet are transformed by the action of the elastomer 4 acting on the opposite side of the sheet, into tensile stresses exerted throughout the surface of the sheet non compensated by the presence of the die bottom 2a and produces the displacement of this sheet in all of the available volume.

These compressive and tensile stresses thus tend to cancel one another (apart from the yield of the elastomer) and thus permit the final realization of the part with a minimum variation in thickness. These variations are necessary in the particular case of the forming of extra thin sheets.

Figure 8:
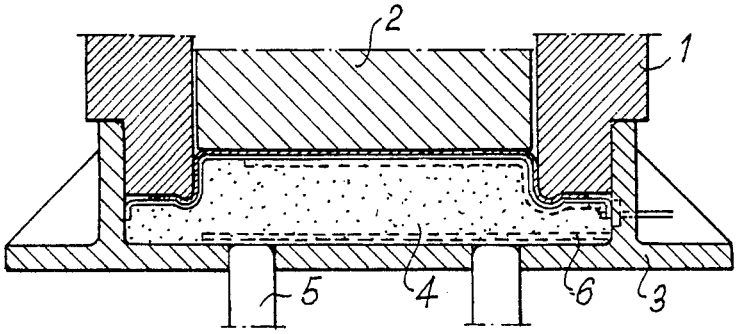

FIG. 8 represents the stage in which the elastomer support 4 is decompressed by the retraction of the pillars 5. The purpose of this operation is to avoid the deformation of the formed part by the reaction of the recovery of the elastomer.

Figure 9:
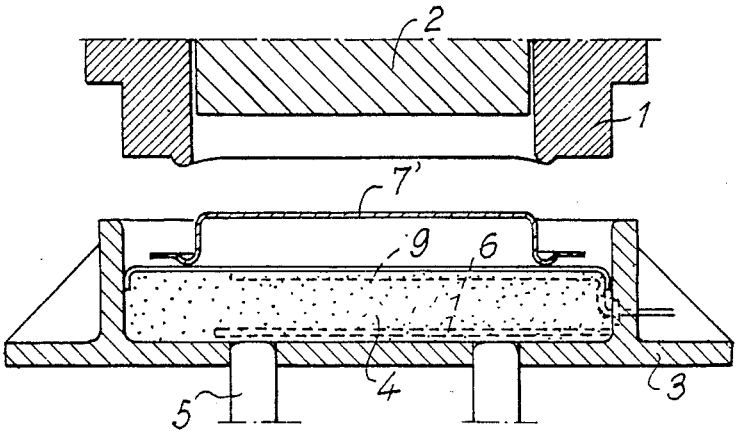

FIG. 9 shows the stage in which the formed part 7 is released by the simultaneous rising of the two slides 1 and 2 carrying the dies. In order to limit the heating of the elastomer support 4, especially when operating under mass-production conditions, compressed air is made to flow in the conduits 6. The cooling of the support 4 may also be achieved in the course of the preceding decompression stage (FIG. 8). Further, compressed air is conveyed through the conduits 9 for the purpose of stripping the part 7.

Figure 10:
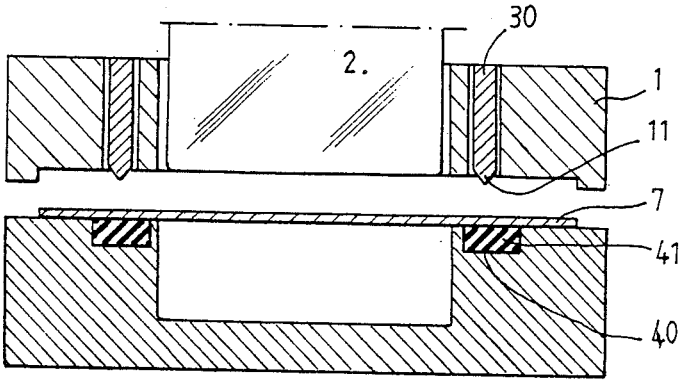

According to a mixed variant shown in FIG. 10, the outer slide or blank holder 1 is of the type illustrated by the first embodiment, namely it comprises active parts 11 in relief carried by elements movable in translation in cavities formed in the blank holder 1.

In confronting relation to these movable parts 11 are cavities 40 filled with a relatively hard elastomer material 41 in which the complementary impression of the active parts 11 in relief will be formed, these parts 11 acting through the sheet 7 which will thus retain in the corners the shape corresponding to the excess area of the sheet relative to the volume of metal to be formed.

When the central portion of the sheet metal blank is formed under the effect of the central slide 2 forming a punch, the movable elements 30 simultaneously descend and in relation with the movement of the punch so as to achieve the same effect a that described in respect of the first embodiments.

FIG. 11 shows an embodiment according to the invention of a part of sheet metal HEL $E=60$ kg/mm$^2$ of 40/100 mm thickness having substantially a rectangular-sided shape of 1.5 m$^2$ surface area. Two sectional views taken on lines 12 and 13 show that excess areas of material, when forming the corner 13, have been displaced toward the base 13a of the corner of the part in a manner corresponding to the parts in relief 11 of the peripheral die 10. Thereafter, a routing operation on the part eliminates the undesirable edge portions 15 and gives the part its final shape.

Figure 14:
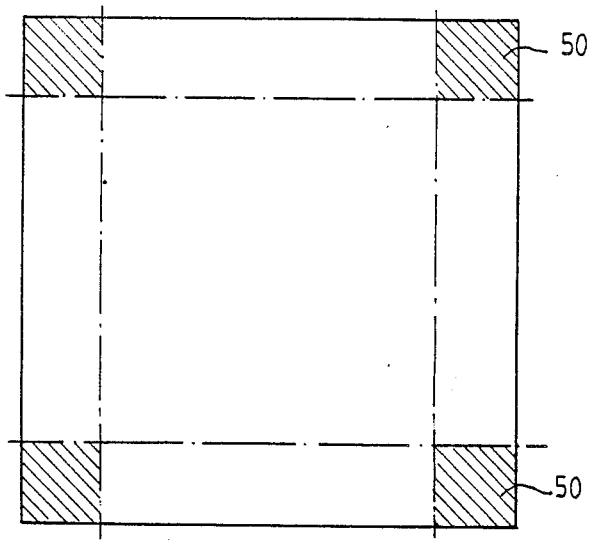
FIG. 14 is a view of a planar rectangular sheet to be formed by one of the press-forming devices according to the invention.
Figure 15:
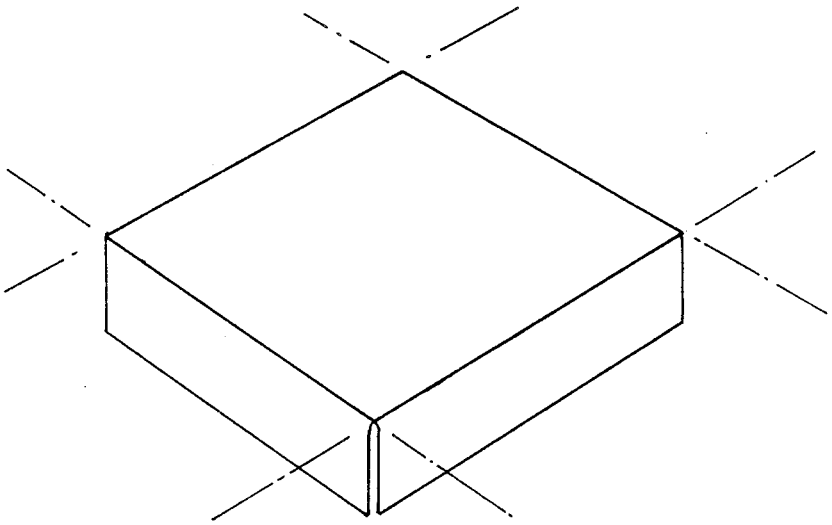
FIG. 15 is a perspective view of a rectangular-sided part formed from the rectangular sheet of FIG. 14.

A further explanation of the invention may be given by the following rectangular-sided part (such as that shown in FIG. 11) could be produced from a planar rectangular sheet (shown in FIG. 14), by folding (FIG. 15) provided a square portion 50 is cut away at each corner of the sheet.

But, if this part is produced in a press-forming operation, this square portion 50 exists in the initial blank of sheet metal and represents the excess material. Now, the object of the present invention is to avoid the formation of any extra thickness or any reduction in the thickness which would be liable to produce pleats or tears, in particular in ultra-thin sheets having in particular deep angular volumes.

The technique for producing the corners of a press-formed volume described hereinbefore provides a solution to this problem.

Indeed, the press-forming die has at each of its corners a suitable part in relief 11 which will produce a hollow at the base of each of the corners of the part to be obtained in a progressive concave shape having an area equivalent to the excess area of material, for example, the square portion 50 mentioned in the preceding paragraph (the forming of a rectangular-sided part).

The compressive stresses due to the excess of material produced by the shape of the part are consequently compensated by the equivalent tensile stresses produced by the shape of the tool (absorption of the excess of material).

The method according to the invention thus permits:

the limitation to the maximum extent of the reduction in the thickness of the sheet metal blank;

the avoidance of concentrations of stresses, and the forming of corners without producing pleats.

Further, the device according to the invention is adaptable to existing double action presses.

The invention may be found to be of particular interest in the production from ultra-thin steel sheet of automobile body parts, aircraft fuselages, etc. . . . However, it is also applicable to the press-forming of thicker sheets of various metals.

Further, it may be noted, in the case of the embodiment effecting a press-forming on an elastomer cushion, that the surface condition of the side of the sheet in contact with the elastomer is completely preserved so that it can be envisaged to form previously-coated sheets without damage to the film of surface coating when press-forming, even if it concerns a film of paint, adhesive or any other organic coating.

What is claimed is:

1. A method for press-forming from a blank of sheet metal of given thickness a part having a substantially constant thickness on a double action press, comprising the steps of calculating the area of the surface of the part to be press-formed, adding a peripheral marginal portion of the sheet around said calculated area for controlling said marginal portion during press-forming and constituting a total area of sheet to be press-formed, said added marginal portion including at least one excess area of said blank of sheet metal relative to said calculated area of the surface of the part to be press-formed, disposing the sheet on a support made of an elastic material, applying a first outer slide, defining a die opening and acting as a blank holder, on said peripheral marginal portion of the sheet overlying said support, said outer slide including at least one part in relief for deforming said at least one excess area of said blank of sheet metal and causing during said press-forming a depression in said marginal portion whose surface area corresponds to said excess area, said method further comprising exerting a pressure by means of the sheet while allowing the sheet to slide under the outer slide by displacing the outer slide relative to said support so as to form said marginal portion of the sheet and compensate for said at least one excess area of the sheet metal to be formed, continuing to displace the outer slide and further compress said support and cause the elastic material of the support to flow and enter said die opening and effect a partial pre-forming of the central portion of the sheet in the manner of a punch and impart a surface area to the sheet substantially equal to the surface area of the finished part to be obtained and then displacing a central slide which is within said central slide and has a surface for press-forming a desired shape of the finished part in a central portion of the sheet so as to complete the press-forming of said central portion of the sheet by a final flowing of the elastic material of the support which continues to act in the manner of a punch.

2. A method according to claim 1, comprising, in a first stage, bringing the central slide into a position in which it limits the deformation of the central portion of the sheet under the effect of the flowing of the support material during said partial pre-forming.

3. A method according to claim 1, comprising providing anti-fraction means on the at least one part in relief of the outer slide and on the support.

4. A method according to claim 1, wherein the material constituting the support is an elastomer having a low Shore hardness.

5. A method according to claim 4, wherein the elastomer has a Shore hardness lower than 30.

6. A method according to claim 1, comprising decompressing the elastic material constituting the support after said completed press-forming operation.

7. A method according to claim 1, comprising cooling the mass of the elastic support material.

8. A method according to claim 1, wherein the elastic material has a Shore hardness of between 70 and 100.

9. A device for press-forming a sheet of metal into a finished part, comprising a support on which said sheet is placed, a first outer side acting as a blank holder and defining a die opening, and a second central slide which is within the outer slide and a has a surface for press-forming a desired shape of the finished part in a central portion of said sheet of metal, the support including a mass of an elastic material occupying the whole of an area corresponding to the outer slide and the central slide, the first outer slide comprising at least one part which is in relief and has a shape having a surface area corresponding to the excess area of the sheet of a substantially constant thickness, relative to the volume of metal to be formed, said part in relief acting on a peripheral portion of the sheet prior to and subsequently simultaneously and in relation with the action of the central slide, stop means being provided and cooperative with said outer slide for stopping the displacement of said outer slide when the surface area of the central portion of the sheet initially press-formed by the entry of the elastic material of said support in said die opening in the manner of a punch has reached the surface area of the desired finished part.

10. A device according to claim 9, wherein the material of the support is an elastomer having a Shore hardness which is lower than 30.

11. A device according to claim 9, wherein the material of the support has a Shore hardness between 70 and 100.

12. A device according to claim 9, comprising movable elements which are movable selectively into and out of the mass of the support material and, in a first stage, project into the mass of the support material when press-forming said sheet and which, in a second stage, are retractable from said mass after the press-forming operation and before said central slide from said support and have a volume substantially corresponding to the volume of said elastic material of said support compressed by the said outer slide and said inner slide in the course of said press-forming and thereby avoiding risk of deformation of the press-formed part when the elastic material of said support resumes its initial uncompressed state.

13. A device according to claim 9, comprising means for cooling the material of the support within the thickness of said material.

14. A device according to claim 9, comprising pressure-producing means located on the surface of said support for exerting a pressure on the finished part and stripping the finished part from the support material.

15. A method according to claim 1, wherein the elastomer has a Shore hardness of lower than 10.

16. A method according to claim 4, wherein the elastomer is a silicone elastomer.

17. A method according to claim 4, wherein the support is a composite support comprising a silicone elastomer having a low Shore hardness and covered on its upper side and on at least a part of its lateral sides with a thin skin of a stronger and harder material.

18. A device according to claim 10, wherein the elastomer has a Shore hardness of lower than 10.

19. A device according to claim 10, wherein the elastomer is a silicone elastomer.

20. A device according to claim 10, wherein the support is a composite support comprising a silicone elastomer having a low Shore hardness and covered on its upper side and on at least a part of its lateral sides with a thin skin of a stronger and harder material.

* * * * *